US007941871B1

(12) United States Patent
Jorgensen

(10) Patent No.: US 7,941,871 B1
(45) Date of Patent: May 17, 2011

(54) GARMENT WITH STRETCHABLE SECTION AND RELATED METHODS

(76) Inventor: Joey Jorgensen, San Clemente, CA (US)

( * ) Notice: Subject to any disclaimer, the term of this patent is extended or adjusted under 35 U.S.C. 154(b) by 0 days.

(21) Appl. No.: 11/492,602

(22) Filed: Jul. 25, 2006

Related U.S. Application Data

(63) Continuation of application No. 10/643,492, filed on Aug. 18, 2003, now abandoned.

(51) Int. Cl.
*A41D 1/08* (2006.01)

(52) U.S. Cl. ..... 2/238; 2/228

(58) Field of Classification Search ..... 2/79, 80, 2/401, 227, 228, 238, 69; 602/19
See application file for complete search history.

(56) References Cited

U.S. PATENT DOCUMENTS

| | | | | |
|---|---|---|---|---|
| 650,956 | A * | 6/1900 | Scriven | 2/401 |
| 1,797,115 | A * | 3/1931 | Atkinson | 2/401 |
| 2,250,218 | A * | 7/1941 | Cadous | 2/401 |
| 2,344,375 | A * | 3/1944 | Stephens | 450/104 |
| 2,561,312 | A * | 7/1951 | Laszlo | 2/67 |
| 2,958,327 | A * | 11/1960 | Geissmann | 450/101 |
| 2,983,924 | A * | 5/1961 | Cohen et al. | 2/67 |
| 3,338,776 | A * | 8/1967 | Blair | 428/88 |
| 3,512,532 | A * | 5/1970 | Sutter | 450/98 |
| 3,894,542 | A * | 7/1975 | Sacristan | 450/123 |
| 4,843,654 | A * | 7/1989 | March | 2/227 |
| 4,862,523 | A * | 9/1989 | Lipov | 2/409 |
| 4,946,453 | A | 8/1990 | Monson | |
| 5,010,596 | A * | 4/1991 | Brown et al. | 2/228 |
| 5,201,074 | A * | 4/1993 | Dicker | 2/70 |
| 5,210,877 | A * | 5/1993 | Newman | 2/456 |
| 5,267,928 | A * | 12/1993 | Barile et al. | 482/124 |
| 5,282,277 | A * | 2/1994 | Onozawa | 2/69 |
| 5,465,428 | A * | 11/1995 | Earl | 2/238 |
| 5,699,559 | A | 12/1997 | Sano | |
| 5,737,773 | A | 4/1998 | Dicker | |
| 5,742,936 | A | 4/1998 | Tronc | |
| 5,829,058 | A * | 11/1998 | Dicker et al. | 2/69 |
| 5,857,947 | A | 1/1999 | Dicker | |
| 5,937,442 | A * | 8/1999 | Yamaguchi et al. | 2/69 |
| 5,968,002 | A * | 10/1999 | Morrisseau | 602/62 |
| 6,041,437 | A * | 3/2000 | Barker et al. | 2/82 |
| 6,176,816 | B1 | 1/2001 | Dicker | |
| 6,186,970 | B1 * | 2/2001 | Fujii et al. | 602/75 |
| 6,199,215 | B1 | 3/2001 | Biggerstaff | |
| 6,231,488 | B1 | 5/2001 | Dicker | |
| 6,243,879 | B1 * | 6/2001 | Lyden | 2/227 |
| 6,363,538 | B1 * | 4/2002 | Davis | 2/247 |
| 6,430,752 | B1 * | 8/2002 | Bay | 2/228 |

(Continued)

FOREIGN PATENT DOCUMENTS

WO WO 02/47501 A1 * 6/2002

*Primary Examiner* — Alissa L Hoey
(74) *Attorney, Agent, or Firm* — Eric Hanscom; Todd J. Langford

(57) ABSTRACT

The present invention is directed to a garment (such as a short, shirt, pants and other garments) having a stretchable section preferably of neoprene, that provides for improved comfort and wearability. The other panels or fabric portions of the garment may be constructed of a relatively less stretchable or even a relatively inelastic material, and the stretchable portion is positioned in an "area of flex" of the garment (so that the stretchable portion can "stretch" when the wearer rotates limbs extending into the garment). Related methods are disclosed for garment fabrication and the like.

10 Claims, 5 Drawing Sheets

U.S. PATENT DOCUMENTS 6,454,628 B1 * 9/2002 Shunichirou ..... 450/155
6,526,584 B1 3/2003 Hunter
6,684,410 B2 * 2/2004 Robinett et al. ..... 2/228
6,712,841 B2 * 3/2004 Gomez ..... 607/114
6,789,270 B1 * 9/2004 Pedrick ..... 2/228
6,874,337 B2 * 4/2005 Uno et al. ..... 66/177
D520,715 S * 5/2006 Ota et al. ..... D2/731
7,074,204 B2 * 7/2006 Fujii et al. ..... 602/75
7,087,032 B1 * 8/2006 Ikeda ..... 602/19
7,093,306 B2 * 8/2006 Villalobos ..... 2/227
7,814,576 B2 * 10/2010 Nakazawa ..... 2/227
2003/0019014 A1 * 1/2003 Duran ..... 2/239
2003/0028952 A1 * 2/2003 Fujii et al. ..... 2/400
2003/0208829 A1 * 11/2003 Ragot et al. ..... 2/67
2004/0107479 A1 * 6/2004 Dicker et al. ..... 2/227
2005/0193461 A1 * 9/2005 Caillibotte et al. ..... 2/69
2006/0074365 A1 * 4/2006 Brown ..... 602/24
2007/0067892 A1 * 3/2007 Oyama et al. ..... 2/227
2008/0083055 A1 * 4/2008 Onda ..... 2/455
2008/0194181 A1 * 8/2008 Sudo et al. ..... 450/123

* cited by examiner

GARMENT WITH STRETCHABLE SECTION AND RELATED METHODS

This application is a continuation U.S. patent application Ser. No. 10/643,492, filed on Aug. 18, 2003 now abandoned. Priority to the aforementioned application is hereby expressly claimed in accordance with 35 U.S.C. §120 and any other applicable statutes. The contents of the aforementioned application, and of each U.S. Patent and other reference, if any, cited in that and/or in this application, are hereby incorporated herein by reference.

FIELD OF INVENTION

The present invention relates generally to garments. More particularly, the present invention relates to a garment having a stretchable section that provides improved "wearability" (including improved comfort, flexibility, and/or durability). Although the invention is useful in a wide range of clothing and applications, it is especially useful for garments intended for physical activity, such as board shorts and the like. In contrast to other athletic garments having stretchable sections that are typically snug or form-fitting, the present invention is especially useful for relatively looser clothing styles such as those commonly worn during surfing or similar activities.

BACKGROUND OF INVENTION

Clothing comes in a wide variety of styles and configurations. There are numerous garments and clothing options, each of which may be suitable for a variety of occasions and activities. The style, size, and configuration of an individual's clothing (including cut, color combinations, and fabric/material type, for example) can present an image for the rest of the world to scrutinize and assess. As such, clothing can provide individuals a means of self-expression of their own style and uniqueness.

In addition to "style" considerations, however, many people also consider other factors in selecting their clothing or garments. Among other things, certain clothing can be appropriate for certain activities, and the wearability, comfort, and material durability or "life" of the garment can be factors. The feel or texture of certain fabrics against the skin can be important (e.g., many people prefer the tactile feel of cotton fabrics rather than wool), as can the temperature transmission properties of the clothing/fabric (e.g., silk may be a popular choice as a warm weather fabric due to "breathability," or may be used in other applications to help provide an insulating layer against cold).

In addition, how the garment moves in relation to movement of the wearer's body can be important. In some instances (including, for example, many athletic or physical activities), it may be desirable to have a garment that fits relatively loosely and/or does not unnecessarily restrict the wearer's movement. Among other things, such restrictions may undesirably limit the wearer's degree of movement, impeding their athletic/physical performance and/or enjoyment.

At least two methods can be used to provide desired "comfort" or freedom of movement in clothing: (1) the clothing can be designed entirely or from substantially all "stretch" material, so that it fits snugly to the body at all times but is capable of expanding or contracting with the wearer's body movement; or (2) the clothing can be designed to be loose fitting, so that the body moves relatively independently from the clothing.

In the form-fitting category are certain activities such as aerobics, bicycling, etc. As indicated above, current fashion/function in those activities includes garments (shorts/leotards/bodysuits/etc.) fabricated all or mostly from "stretchy" material, so that the garment/fabric is "stretched" to some degree even when the wearer is at rest. Stretchable fabrics (such as spandex or LYCRA®, for example) typically can expand but have material memory that urges the garment to its original shape and size (or to a snug fit on the wearer's body) once the stretching force is removed (e.g., once the wearer returns to a resting posture).

Such restrictions on movement also can occur, however, (at least to some degree) even if the garment is "loose" rather than form fitting or snug on the wearer. By way of example, for activities such as surfing, wakeboarding, and/or skateboarding, "loose-fitting" board shorts and other clothing typically are worn in a relatively baggy style (not snug fitting). Commonly, such clothing is suspended on the wearer's body only (or primarily) at the wearer's waist or otherwise (via buttons, a drawstring, Velcro, or other suitable fastening means). For such activities, persons typically do not choose to wear tight clothing, except when the weather and/or water is so cold as to make desirable the wearing of wetsuits or the like.

Similar considerations exist for "all in one" style garments, such as wetsuits or the aforementioned bodysuits, and perhaps to an even greater degree. Whether fabricated from stretchable materials or in a "loose" style, the fact that the wearer's arms and legs may simultaneously be "pulling" on the garment during certain body movements can add to the amount of restriction the wearer may experience from the garment.

Substantial or repetitive body movement (such as can occur during exercise or certain physical activities) also can place stress on a garment's fabric and seams. In certain situations or at sufficient stress levels, this can result in tears or rips along the seam(s) or body of the fabric, and/or in unsightly deformation or bulging of the garment material. This can occur even with the aforementioned all-stretch garments, but certainly with the loose-fit style clothing.

Moreover, despite their benefits (such as those mentioned above), some stretchable fabrics can be relatively more delicate (less rugged) than other garment materials. Certain activities, or at least certain areas of garments for those activities, conventionally require a relatively tougher material, to withstand the wear and tear of the activity and/or to at least somewhat protect the wearer. Accordingly, there can be a trade-off in garment design between (1) relatively tougher (and typically less stretchable) material, and (2) the aforementioned "comfort" or freedom of movement.

Garments (such as bicycle shorts) made substantially or completely from such relatively stretchy materials can also be inappropriate or undesirable for certain applications. Among other things, they can be very form fitting and/or relatively transparent (which a modest wearer may not want), and may tend to ride up or bind or slip off of certain areas of the wearer's body (especially during the movements of exercise and the like).

As new and more extreme sports evolve, and as people take existing sports and activities to further extremes, clothing designers continue to address issues of this nature and try to balance new and existing stretchability/toughness quandaries. Many sports or activities further complicate the process because they include a substantial element of moisture, in the form of the wearer's perspiration, exposure to the elements (ocean/surf/swimming, rain, etc.), or both. Among other things, "board sports" (including surfing, wakeboarding, snowboarding, etc.) continue to evolve, and the style and "comfort" demands and desires for appropriate garments/clothing evolve as well.

SUMMARY

The present invention is directed to garments having one or more stretchable sections positioned in an otherwise relatively less stretchable (or "non-stretchable") garment. Among other things, the one or more stretchable sections preferably provide improved wearability when worn by the user. The relatively "more stretchable" section or sections preferably are constructed of neoprene, although other materials such as spandex, LYCRA®, lined neoprene (an "ultraflex" material that provides at least 4-way directional stretch capabilities to the stretchable material), or the like may be used. The relatively more stretchable section(s) preferably are selectively shaped and positioned on an article of clothing in an area where the wearer's body movement may cause stress to the garment material. The relatively more stretchable material facilitates garment expandability, thus providing for improved garment wearability, increased wearer comfort, and extended garment life. Among other things, the inventor is not aware of any prior art that combines neoprene panels within a garment of any type of non-neoprene stretch material.

For certain garments and applications (e.g., board shorts), the relatively stretchable or more stretchable fabric section can be provided in a substantially arcuate elongated strip, passing across the buttocks of the garment. The substantially arcuate shape allows the stretchable material to be positioned along areas of the garment adjacent the wearer's lower trunk/torso and lower extremities, so that the stretchable fabric section can reduce stress on other portions of the garment material (which might be caused, for example, by the wearer's body movements such as bending or twisting at the waist, extension of the leg, and/or flexion of the hip or knee).

In some of the many other embodiments of the invention, the stretchable material can be positioned along areas of the garment adjacent the wearer's upper trunk and arms (areas where the garment material similarly may be stressed due to the wearer's body movements). The precise shape, size and positioning of the more stretchable fabric section can vary widely, depending on many factors, as described above (including the specific activity, the anticipated movements of wearers, general comfort considerations, etc.).

By way of further example, the relatively stretchable material section may extend along a length of (or across) the torso and/or the arms or legs of the garment, and may be continuous or in separate pieces at separated locations on the garment. Alternatively, the stretchable section may extend along or across the entire length of the torso and/or the arms or legs of the garment, extending even from edge-to-edge of the garment.

Stretchable material located between relatively less-stretchable garment material (with the stretchable and less-stretchable portions collectively forming the body of the garment) allows the garment (even if "loose fitting") to expand or "give" with body movement. Among other things, and as mentioned above, this can result in increased garment "life" because there is no sliding or dragging of garment material, i.e., no garment material frictional force to overcome.

Strategic areas for positioning the stretchable material section(s) would include (by way of example and not by way of limitation) the buttocks, shoulder, elbow, wrist, leg, hip, ankle, and/or knee areas of the garment. Among other things, those "flexing" areas of the wearer's body are likely to benefit from adjacent "stretchable portions" built into the garment.

Moreover, although prior art 2-way stretch materials have been used in certain garments (for example, board shorts), the invention's use of dissimilar stretch materials within a single garment (such as the inclusion of a stretchier (e.g. 4-way stretch neoprene) panel within a single such garment brings a heightened degree of comfort, flexibility, and fashion.

DETAILED DESCRIPTION OF THE DRAWINGS

DETAILED DESCRIPTION

Figure 1A:
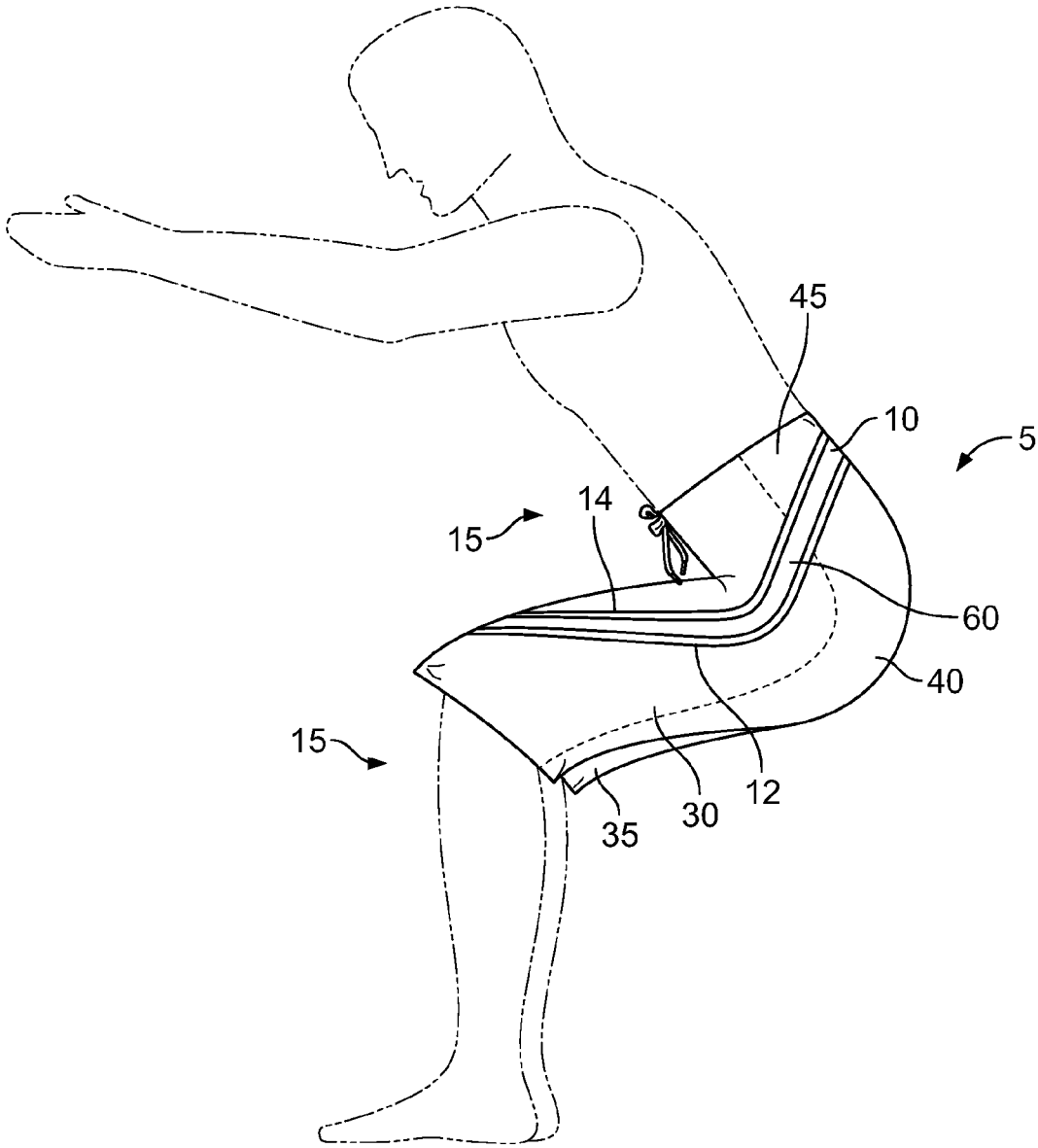
FIG. 1A is a side elevation view of a preferred embodiment of the invention, showing a garment 5 adapted to be worn by a person (shown in phantom, in a flexed position) having a relatively stretchable section 10 positioned within relatively non-elastic or less stretchable material.

As illustrated in FIGS. 1A-E, a preferred embodiment of the invention includes a garment 5 having a stretchable section 10 forming an integral portion of the garment. The stretchable section preferably is fabricated from a stretchable material, such as elastomeric foam, spandex, LYCRA®, neoprene or a neoprene-type material known as "ultra-flex", or a similar type of material. For board shorts, the stretchable material is preferably stretchable neoprene having sufficient elasticity to allow the repeated stretching described herein during the wearer's various body movements and to return to its original unstretched condition.

Also preferably, the remaining portions of the garment 5 are fabricated from any suitable relatively less-stretchable or non-stretchable materials, such as a polyester blend or the like. Other materials include, without limitation, cotton, polyester, nylon, or blends thereof. Although the preferred embodiment includes a relatively more stretchable section 10 within a garment principally fabricated from a less stretchable material, the precise ratio of more to less stretchable materials within the garment can vary widely.

In the embodiment of FIGS. 1A-E, the stretchable section 10 preferably is provided as an elongated strip having first and second longitudinal edges 12 and 14 that are generally parallel to a longitudinal axis of said strip. Among the many alternative embodiments of the invention, however, the more stretchable section or insert can take a wide variety of shapes and sizes other than those shown in the drawings, with greater tapering, rounded shapes, etc.

The strip 10 preferably also includes first and second ends 16 and 18 (FIG. 1E) at the extremities of the longitudinal axis of the strip. The first end 16 preferably is positioned to form a portion of an edge of the garment's leg 35, and the strip itself preferably traverses from there upwardly and around the back of the garment 5, terminating in the second end 18 forming a portion of an edge of the garment's other leg 30.

The first and second longitudinal edges 12 and 14 preferably are attached (via sewing, gluing, welding (including seamless welding), melting, weaving, or any suitable means or method) to corresponding/confronting edges of the relatively less-stretchable garment portion.

As indicated above, persons of ordinary skill in the art will understand that the specific shape(s) and location(s) of the stretchable section(s) 10 within the garment 5 (as well as the specific nature, relative stretchability, color, and other characteristics of the stretchable and less-stretchable or non-stretchable sections of the garment 5) can vary depending on the application for which the garment may be intended.

In the embodiment of FIGS. 1A-E, the preferably relatively more stretchable material 10 is illustrated as having a substantially arched or arcuate shape, and as extending from a lower front edge of the board shorts 5 continuously around the back of the shorts and back down the opposite leg to its edge. Wherever the stretchable material 10 is located on the garment, it preferably can stretch in response to the wearer's movements (such as the when the wearer moves into the position illustrated in FIG. 1A), permitting increased flexibility and expansion of the garment and less resistance to the wearer in various directions during certain movements.

In addition (for embodiments such as illustrated in FIGS. 1A-E), because the stretchable section 10 bisects or extends completely "across" the garment 5 in that manner, the entire garment can shift in response to the wearer's movements in ways not possible without the stretchable portion 10. Specifically (and in addition to conventional bending and/or expansion of the stretchable section 10 in various directions), the opposing edges of the relatively less-stretchable portions of the garment adjacent the stretchable section 10 (i.e., the edges that are operatively sewn or otherwise joined to the edges 12 and 14 of the stretchable section 10) are relatively "free" (within the limitations of the stretchable section 10) to "shift" with respect to each other.

As indicated above, some of the many other embodiments of the invention (not shown) can include differing shapes and locations of the stretchable portion 10, and/or multiple (distinct/separate) stretchable portions 10 within the same garment 5. Among those many alternatives would be ones similar to that illustrated in FIGS. 1A-E, but having the elongated strip 10 extending from somewhere other than the front edge of a first leg to the front edge of the opposite leg. In such embodiments, the ends 16 and 18 could, among other things, terminate completely within the body of the garment itself (rather than extending to one or more of its edges), form a continuous loop around the wearer's torso and/or the wearer's legs (or one of them), or have some other position within the garment. In any such embodiments in which the stretchable portion did not completely bisect the garment, some degree of the "shifting" mentioned above may not exist in the garment (as compared to bisected garment embodiments), but many benefits of the invention will still be present in such garments.

Although the stretchable portion 10 is illustrated as symmetrical with respect to the right and left sides of the wearer's body, alternative embodiments would include not having such symmetry regarding the strip 10 or otherwise.

The stretchable material section can be positioned within the article of clothing in an area where body movement may cause stress to the garment material to reduce or eliminate the stress. The stretchable material facilitates ease of garment material expandability, thus providing for improved garment wearability by increasing wearer comfort and garment life.

In FIGS. 1A-1E, the garment 5 has a stretchable section 10, and is adapted to be worn about a portion of the person's lower trunk/torso and lower extremities or legs 15. The alternative embodiment illustrated in FIGS. 2A-B illustrates the invention as it may be incorporated within a shirt or top 55. Among the many other alternative embodiments of the inventions are tops with short sleeves (rather than the long sleeves of FIGS. 2A-B), unibody garments (having both legs and arms within a single garment), pants/shorts/bottoms that incorporate straps extending over the wearer's shoulders to held retain the garment on the wearer, and many others.

As shown in FIGS. 1A-E, garments embodying the invention may include shorts 5 such as board shorts or surf shorts that are typically supported at approximately the wearer's waist and extend to about the knees. Such shorts could alternatively have legs that terminate higher or lower on the wearer's legs. Pants (not shown) may similarly incorporate one or more relatively stretchable sections 10, and the term short or pants is not intended to be strictly limited. Among other things, the invention may be used in any garment 5 that may be worn about or cover a portion of the lower trunk/torso including any portion of the legs 15 of a person's body. Alternative terms for such a garment 5 may include trousers, slacks, knickers, breeches, board shorts, jams, etc. The aforementioned garments 5 may be used by the wearer for any event or activity in which the wearer may derive the benefits of the present invention, as described herein, or simply for relative comfort as compared to wearing clothing that does not incorporate the invention.

Stretchable fabric selectively positioned in a garment of relatively less or no stretchability can provide the added benefit of relieving fabric or seam stress (such as along the edges 12 and 14, or at other seams within the stretchable material 10 or the less-stretchable material), by allowing the garment to expand or "give" with body movement. This in turn can result in extended garment "life."

Figure 1C:
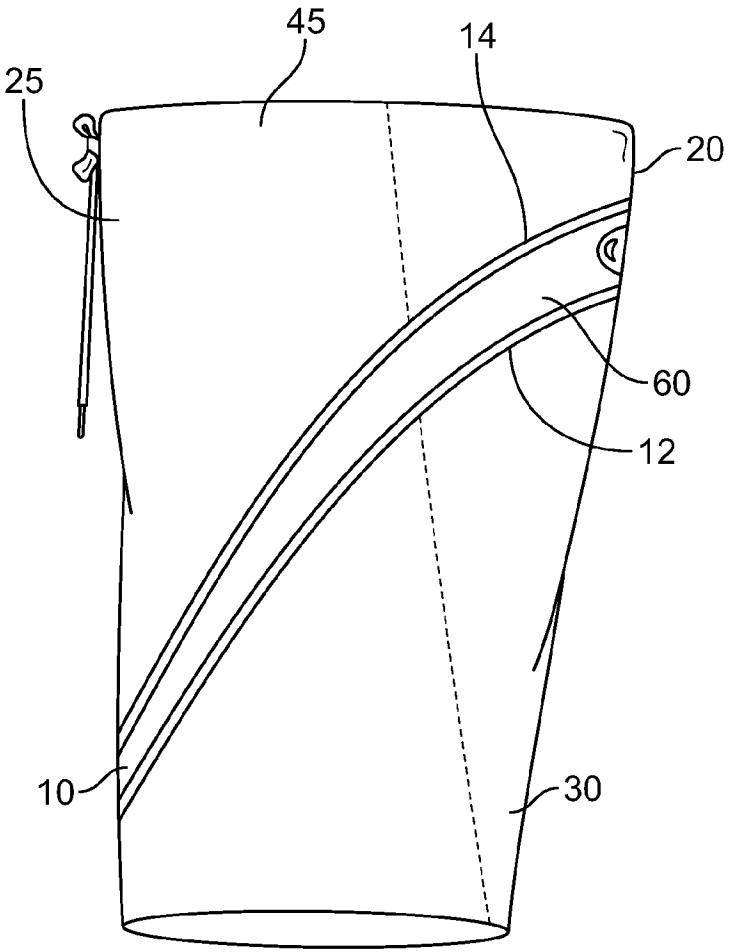
FIG. 1C is a side elevation view of the garment 5 of FIG. 1B, from the wearer's left side.
Figure 2A:
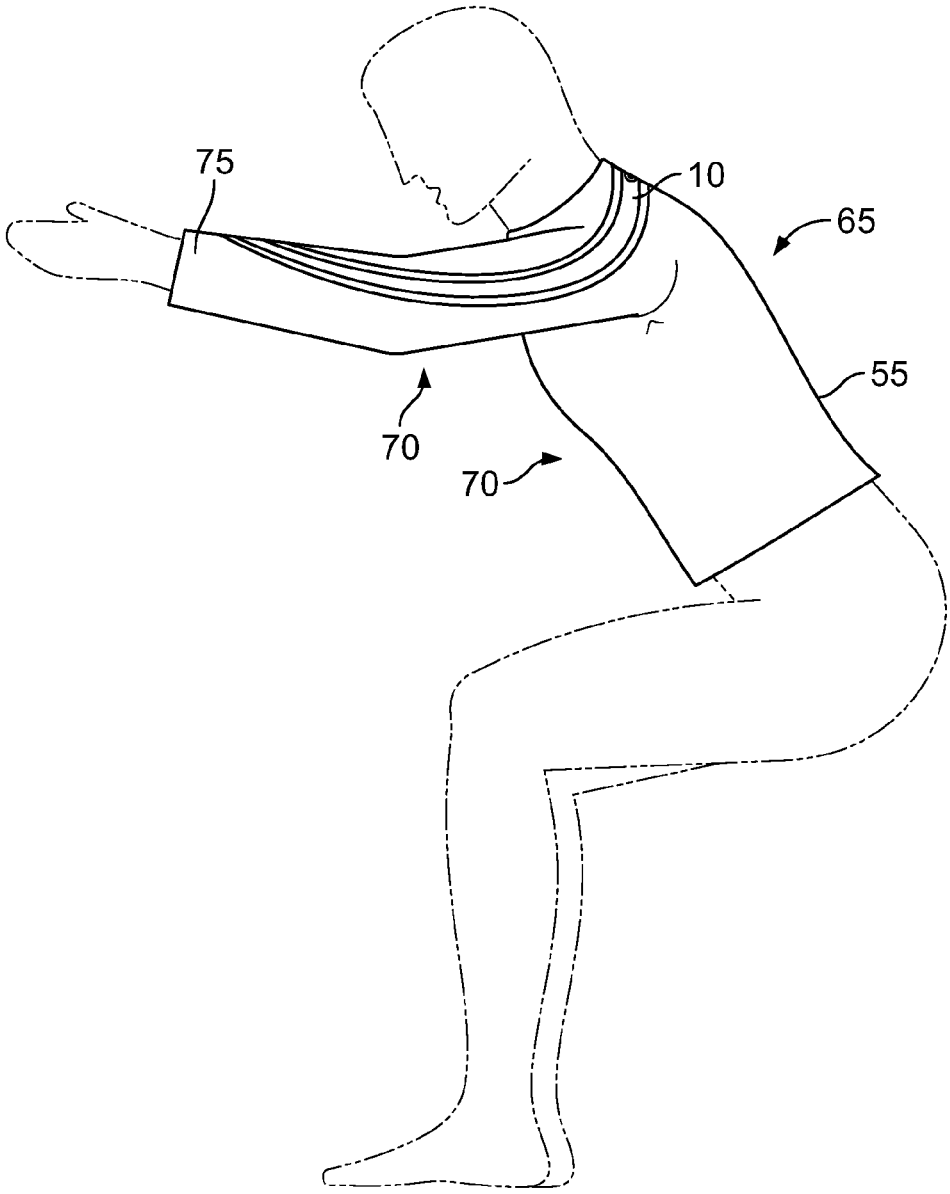
FIG. 2A is a side elevation view of one of the many alternative embodiments of the invention, showing a garment 55 similar to garment 5 of FIGS. 1A-E, but adapted to be worn on a person's upper torso.
Figure 2B:
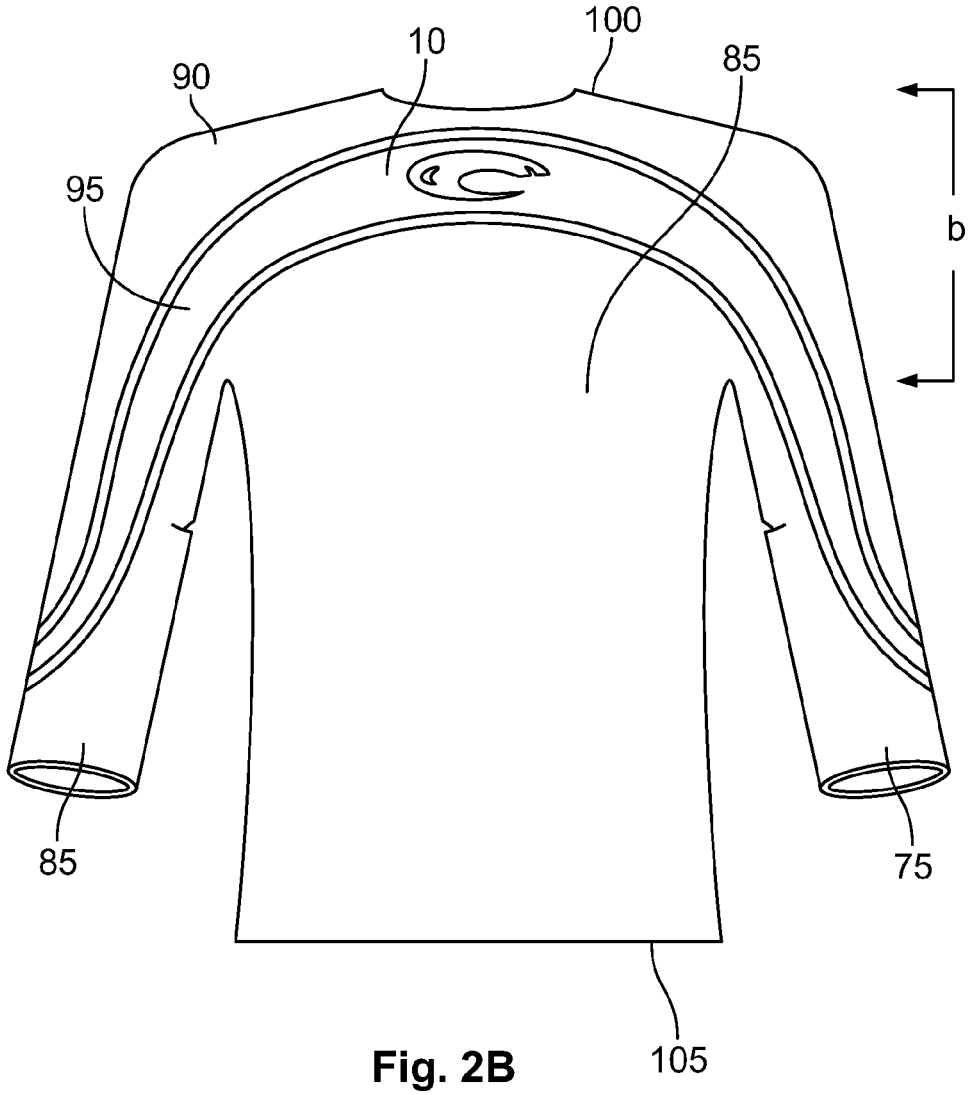
FIG. 2B is a back view of the garment 55 of FIG. 2A, with the garment shown in its normal, non-stretched configuration.

FIG. 1C illustrates the garment 5 having a first leg or section 30 adapted to receive within and permit to pass therethrough one extremity (such as a leg) of a person. In one embodiment, the first section 30 of the garment 5 is a covering such as a pant leg or a leg that is associated with the corresponding pants or short. As described herein, such a covering 30 may begin approximately at the wearer's waist and have a length that may vary depending on whether the garment 5 is intended for use as a short or pants. For example, a leg covering for a short may cover only a small length of the thigh, or the leg covering may cover the entire length of the thigh from the waist to an area about the knee. In one embodiment, the present invention has an outseam (measured from the top of the waist to the bottom of the garment) of approximately 22 inches on a size 32 waist garment (other waist sizes can have similar proportions, or may differ in their length/waist ratio). Likewise, a leg covering for pants may extend a length from approximately the waist to mid calf "pedal pusher", or the leg covering may extend the entire length of the leg to the ankle or beyond.

In addition, as described herein, the first section 30 may be constructed of a single panel or multiple panels depending on garment style, material, and intended application. Thus, a first section or leg covering 30 is a term used to describe the entire portion of the garment 5 that is generally considered to cover that portion of the leg or lower extremity 15 intended to be covered. In the context of the first section being a leg covering, the extremity 15 will be a leg of a person. As with most shorts or pants, the leg covering permits a leg to be received and to pass therethrough, as shown in FIG. 1A.

Figure 1B:
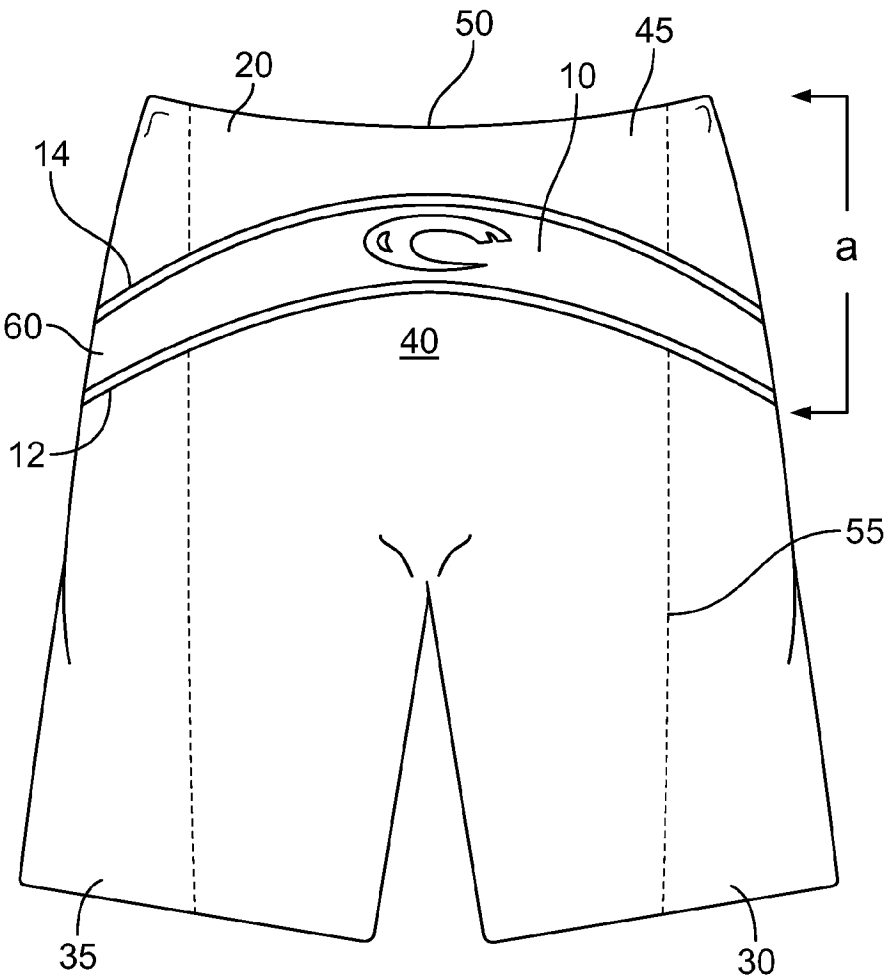
FIG. 1B is a back elevation view of the garment 5 of FIG. 1A, with the garment shown in its normal, non-stretched configuration.
Figure 1E:
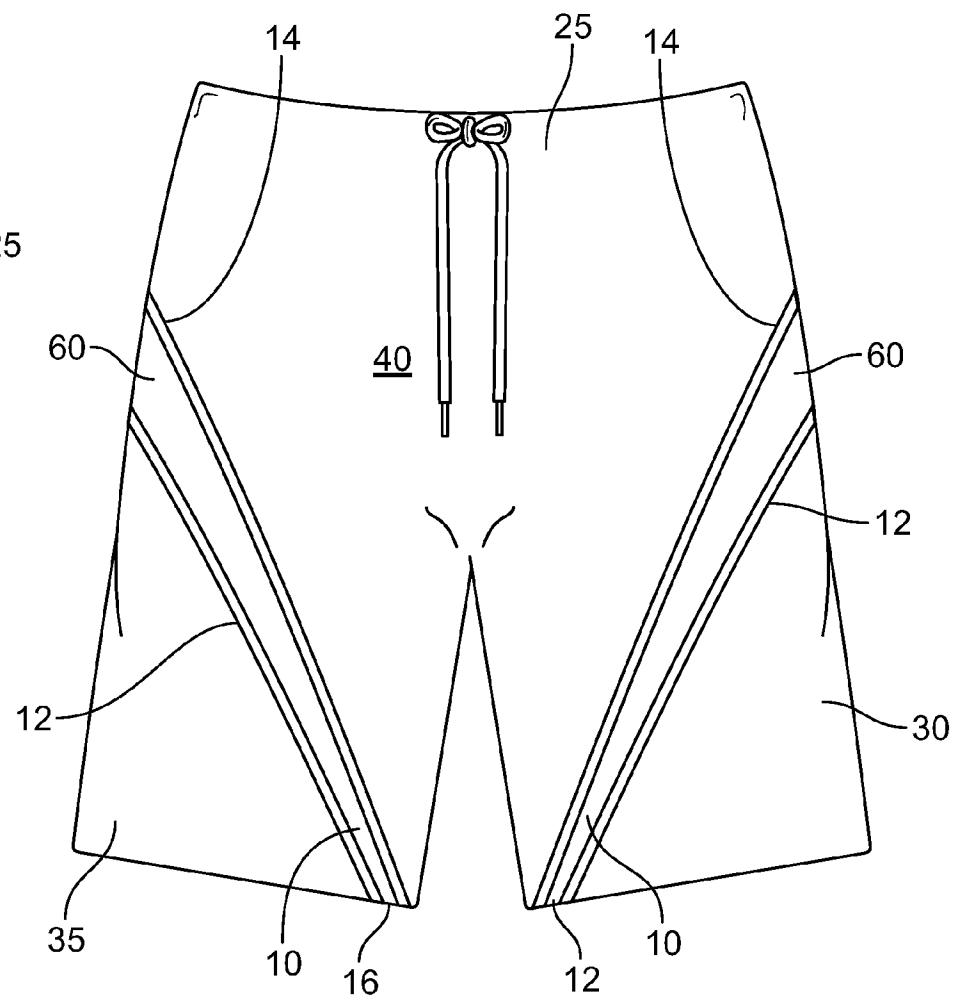
FIG. 1E is a front elevation view of the garment 5 of FIG. 1B.
Figure 1D:
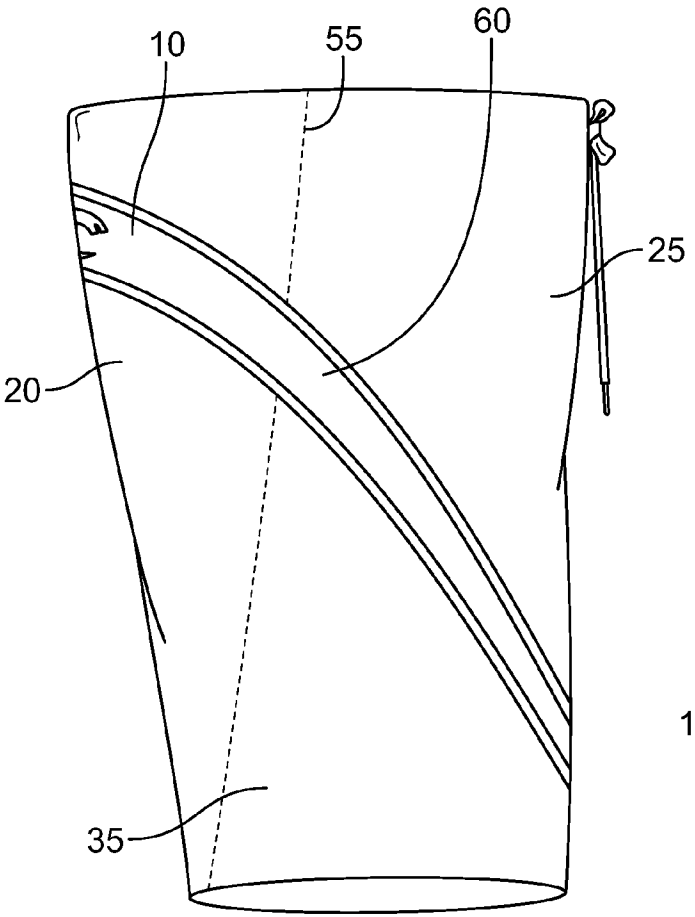
FIG. 1D is a side elevation view of the garment 5 of FIG. 1B, from the wearer's right side.

Likewise, as shown in FIG. 1D, the garment 5 further includes a second section 35 adapted to receive within and permit to pass therethrough the opposite leg or extremity of the person. Therefore, continuing with the description of the aforementioned embodiment as being shorts or pants, the second section 35 would, similar to the first section 30, be a covering such as a pant leg or leg of a short and the opposite extremity would be a leg of the person, but not the leg received by the first section 30. Thus, when describing an extremity used with a particular garment 5 it will be understood that the opposite extremity is of the same character, e.g., if one extremity is a leg, then the opposite extremity is the other leg, or, as described her'ein, if one extremity is an arm, then the opposite extremity is the other arm.

Preferably, and as illustrated in FIGS. 1A-E, the first section 30 and the second section 35 (leg coverings) are substantially similar. Thus, for ease of describing the present invention, it will be understood that except for differences specifically described herein, the description of the first section 30 of the garment 5 at least generally applies to the second section 35 of the garment 5.

The garment 5 can be further described as including a third section 40 adapted to receive a portion of a person's body such as the torso. The third section 40 joins together the first section 30 and the second section 35. In one embodiment, as shown in FIGS. 1B and 1E, the third section 40 is the portion of the short or pants that is broadly considered to cover the lower trunk/torso of a person including the buttocks and groin areas. In this regard, the third section 40 may be described as having a back portion 20 connected to a front portion 25. The back portion 20 of the third section 40 is used to cover that area of the body generally considered the buttocks, and the front portion 25 of the third section 40 is used to cover that area of the body generally considered the groin. The third section 40 has a top area 45, formed by the back portion 20 and the front portion 25, generally positioned on the garment 5 such that when worn by the user the top area 45 contacts the user's body generally along the waist and hip region. Thus, as shown generally by arrows "a" in FIG. 1B, the top area 45 of the third section 40 may be considered to extend from a top edge 50 of the garment 5, near the wearer's waist, to approximately six inches below the top edge 50. Regardless of that dimension, the preferred embodiment of FIGS. 1A-E preferably includes the stretchable section 10 positioned so as to pass across and over the buttocks (whether or not within six inches of the top of the garment) and thereby permit the desired flexing of the wearer's legs described herein.

As shown in FIGS. 1A-D, the third section 40, the first section or leg 30, and the second section or leg 35 can be formed by multiple pieces of fabric sewn or otherwise joined together along seams 55. As shown, the seams 55 and the multiple pieces of fabric between the seams can cross through one or more of the third section 40, the first section or leg 30, and the second section or leg 35.

In alternative embodiments (not shown), the number and location of any such seams can vary in any suitable manner, to provide a useful, comfortable, functional garment. Seams 55 or similar "joints" in the garment may (again, in alternative embodiments) be joined by thread, VELCRO, button(s), snap (s), or any suitable securing means. As indicated above, positioning of the seams 55 can vary depending on a variety of factors, including (for example) the garment style, garment material, and the intended use of the garment 5. As such, persons of ordinary skill in the art will understand that the terms first section 30, second section 35, and third section 40 are used to describe various portions of the garment 5 relative to each other in terms of how they are positioned when worn on the body, and not necessarily defined by how or where each are joined to the other garment 5 sections.

For example, the first 30, second 35, and third 40 sections may be formed from a single piece of material or fabric joined substantially near the groin area such that the third section 40 is contiguous with the first section 30 and the second section 35. Thus, defining an exact point on the garment 5 where the first section 30, second section 35, and third section 40 begins or ends is difficult unless garment 5 positioning on the wearer's body is used as a reference. As such, the first section 30 and second section 35 are each generally positioned to cover the wearer's legs and the third section 40 is generally positioned about the wearer's waist and intended to cover the buttocks and groin areas.

The stretchable section 10 may also be described as a fourth section 60 constructed of a stretchable material 10. As indicated above, the garment material (used to construct the first 30, second 35, and third 40 sections; in contrast to the stretchable material 10 used to construct the fourth section 60) may be of any type material/fabric other than the stretchable material/fabric 10 used to construct the fourth section 60.

Preferably, the fourth section 60 is at least partially positioned along or near the top area 45 of the garment 5 formed by the back portion 20 of the third section 40. In the preferred embodiment, the fourth section 60 also extends continuously along a length of the first section or leg 30 and the second section or leg 35 and thus, the fourth section 60 has a substantially arcuate shape within the assembled garment. In other words, and as shown in FIGS. 1B-1E, the fourth section 60 tends to arch or bend like a bow as it transverses from the first section 30, along the third section 40, to the second section 35. This preferred substantially arcuate shape allows the stretchable material 10 to be positioned in various areas of the garment 5 where the garment may be stressed during the wearer's movements, while providing efficient manufacturing, assembly, and handling of the garment. The aforementioned alternative embodiments may include multiple discrete stretchable sections 10, although fabrication of such embodiments would likely be somewhat more complex than the illustrated preferred embodiments.

As indicated above, movement by the wearer may cause stress to the garment 5 (including its seams). Typically, for board shorts such as shown in the preferred embodiment, body movements such as bending or twisting at the waist, or flexion of the leg or knee exemplify the type of movements that stress garment material. The preferred positioning of the stretchable material 10 in the top area 45 in the back portion 20 of the third section 35 helps address or relieve some of these stresses, although the stretchable section/material could be placed in a wide variety of other locations and still provide benefits to the wearer.

As illustrated in FIG. 1A, as the wearer begins to move their lower trunk/torso (such as by bending forward, twisting along the waist, or flexing the hip and/or knee area), the garment 5 has a tendency to cling to the certain contact points on the wearer's body due to frictional forces or otherwise, or is simply forced to flex by the overall movement of the wearer's body. In any case, such movement can cause garment seam stress and restrict movement. These problems/risks are increased by continued or repetitive movements in a relatively short period of time, such as is typically performed in sporting activities.

These detriments may occur (or may be even further increased) in some garments 5 only during their intended use. For example, swim trunks or board shorts typically used by surfers, skim boarders, or other water activity participants may hang loose on the wearer when dry, but may become heavy and cling or drape on the wearer when saturated with water or sand. Bending or twisting movements, and leg positioning including flexion and extension in the water-laden swim or board short becomes more difficult as the garment material adheres to the body, stressing the garment's seams and also makes movement less comfortable.

Areas of the garment 5 typically subject to relatively high stress due to body movements include the top area 45 of the garment 5 formed by the back portion 20 of the third section 35 where bending or twisting movements of the waist tend to cause problems associated with the garment 5 (short or pants). In addition, leg, hip, and/or knee flexion will typically cause garment material stress along the first section 30 and the second section 35 where the aforementioned sections contact the thigh, hip and/or knee regions of the wearer.

Positioning of a fourth section 60, constructed of stretchable material 10, at least in this top area 45 of the back portion 20 of the third section 35 where body movement may cause stress to the garment material, facilitates ease of garment material expandability, thereby providing for improved garment wearability by increasing wearer comfort and garment life. For example, continuing with the swim trunk or board short scenario mentioned above, although the swim trunk may be securely attached about the wearer's waist and adhere to the wearer's buttocks or legs when laden with moisture, as the wearer bends at the waist the invention's stretchable material 10 (located between the relatively less stretchable garment material) preferably flexes (expands and/or contracts) with movement of the wearer's body. This flexing/expanding/contracting allows the other garment material to remains generally positioned in its normal location on the wearer's body, or at least to reduce the amount of force/stress and/or degree of sliding movement of the garment over the wearer's skin. Thus, the stretchable material 10 decreases garment stress and increases wearer comfort and mobility.

Depending on the materials selected, the size of the wearer, and other factors, the precise dimensions of the various garment sections (including stretchable section 60) can vary greatly. In one embodiment, the fourth section 60 of relatively more stretchable material 10 along the top area 45 can be approximately 2.5 inches wide. This amount of stretchable material 10 width has been found to provide enough expandable material to allow the wearer to bend, twist, or otherwise move about the waist without the garment 5 unduly binding to the wearer and/or stressing the garment material. Benefits, as described herein, may also be derived using stretchable material 10 having a width greater than 2.5 inches and less than 2.5 inches, so long as there is sufficient stretchable material 10 to expand and contract with the intended body movement or to provide improved performance of the garment (as compared to garments not having a stretchable fourth section 60).

The stretchable fourth section 60 can taper or otherwise change width or other characteristics along its length (including alternating between wider and narrower sections repeatedly along the length of that section). As illustrated in FIGS. 1A-E, for example, the strip 10 tapers from a widest region (at the wearer's lower back) to narrower regions (at the bottom edge of each leg 30 and 35). A dimension of about 1.5 inches has been found to be suitable in that narrower leg region, although that dimension can be increased or decreased as mentioned herein.

In some instances, for aesthetic reasons, it may be desirable to have as little stretchable material 10 as possible on a particular garment 5 or at a particular location on the garment. Such may be the case with clothing (short or pants) for people who may want to have the freedom of unrestrained movement yet desire to have clothes that are considered by some to be more fashionable. Thus, the stretchable material 10 may be placed along some or all of the top of the third section 35, so that the wearer may enjoy the freedom of movement provided by the stretchable material 10 while maintaining a potentially more stylish or alternatively stylish look.

More generally, the precise size, shape, and positioning of the one or more relatively "stretchable or more stretchable" sections 10 can take into account aesthetic considerations. For example, by making the color of the stretchable section 10 different from the adjacent fabric, various visual effects or patterns (or even symbols/messages/etc.) can be created.

Depending on selection of fabrics and the colors thereof, as well as the methods of assembly and other factors, the stretchable section 10 can even be made to "blend in" visually with the remainder of the garment. This provides certain aesthetic effects, and/or makes it less likely that third persons will notice the "stretch panel" within the garment.

As described above, fourth section 60 may extend continuously along a length of each of the first section or leg 30 and the second section or leg 35. For example (although not illustrated), the fourth section 60 may terminate near the hip area of each of the first section 30 and the second section 35 (thus extending only partially into the garment legs). Alternatively, as shown in FIG. 1E, the fourth section 60 may extend along an entire length of each of the first section 30 and the second section 35. In other words, the strip 60 may extend to any suitable length through the garment.

As indicated above, similar to the benefits derived by having the stretchable material 10 positioned along the top area 45 of the back portion 20 of the garment 5, stretchable material 10 located between garment material along the first section 30 and the second section 35 will expand and/or contract with movement of the body while reducing or eliminating (a) stress on the other garment material and (b) sliding or dragging of garment material on the wearer's leg or hip area.

As illustrated in FIG. 1E, the fourth section 60 may extend along the entire length of each of the first leg covering and the second leg covering. This stretchable material 10 width (even though tapered to narrower than on the lower back of the garment) preferably provides enough expandable material to allow the wearer to flex, extend, or otherwise move about the hip and leg regions without unduly binding or stressing of the garment material. Benefits, as described herein, may also be derived using stretchable material 10 having other widths so long as there is sufficient stretchable material 10 to provide some desired expand or elastic action with the wearer's body movements.

The benefits of the invention in a garment 5 intended for wear about a person's lower trunk/torso are similar to those for a garment 65 intended for wear about a person's, upper trunk/torso and extremities 70 (such as a shirt, pullover, or similar type apparel). For ease of describing the present invention, it will be understood that the foregoing description of the present invention as applied to a garment 5 such as a short at least generally applies to embodiments such as a shirt 65 (as shown in FIGS. 2A and 2B). Similar to a garment 5 such as shorts or pants, as described above, the garment 65 intended for wear about a person's upper trunk/torso 70 includes a first section or arm 75 adapted to receive within and permit to pass therethrough one extremity (an arm) of the person and a second section or arm 80 adapted to receive within and permit to pass therethrough the opposite extremity (arm) of the person. In other words, the first section 75 and second section 80 of the garment 65 will typically be a sleeve or arm covering.

The arm covering permits an arm to be received within and to pass therethrough, as shown in FIG. 2A. Similar to leg coverings of a short, the sleeve of the shirt may be of varied lengths. For example, the sleeve may extend to an area of the person's upper arm or extend to the wearer's wrist or beyond. The garment 65 also includes a third section 85 having a back portion connected to a front portion. The front portion (not shown) and back portion 90 are adapted to receive a portion of a person's body; in this case the person's chest and back region. As with the third section 40 of the short, the third section 85 of the shirt joins together the first section 75 and the second section 80 (sleeves) of the garment 65.

As best shown in FIG. 2A, the garment 65 includes a fourth section 95 constructed of a stretchable material 10 located between other garment material. The fourth section 95 preferably has a substantially arcuate shape, and is positioned along a top area, as shown generally by arrows "b" in FIG. 2B, of the garment 65 formed by the back portion 90 of the third section 85. Similar to a short or pants embodiment, the top area of the third section 85 of the shirt may be considered to extend from a top edge 100 of the garment 65 to approximately six inches below the top edge 100 (although other dimensions may apply and be used).

The fourth section 95 extends continuously along a length of each of the first section 75 and the second section 80. The substantially arcuate shape of the fourth section 95 allows the stretchable material 10 to be positioned along areas of the garment 65 (such as the person's back, shoulder region, upper arms, and/or elbow/forearm) where the garment material may be stressed due to the wearer's body movements.

The top area formed by the back portion 90 of the third section 85 is one such area where body movement of the shoulders or upper back of the wearer may cause stress to the garment material including seams. Typically, extending or reaching with the arms, and hunching or rolling the back exemplify the types of movement that stresses shirts or similar garments as the garment material is stretched or caused to expand against the frictional force between garment material and the person's skin. These types of movements are particularly detrimental when a bottom edge 105 of the third section 85 is tucked-in or secured by the wearer's short or pants, thus restricting garment material movement.

Stretchable fabric such as spandex, LYCRA®, neoprene or the aforementioned neoprene material known as "ultra-flex", or a similar type material positioned in these stressed regions along the first 75, second 80, and third 85 sections of the garment 65, provide the benefit of relieving seam stress by allowing the material to expand or "give" with body movement resulting in increased garment "life". Thus, the stretchable material 10 appropriately positioned on the garment 65 provides improved wearer comfort and garment durability, i.e., wearability.

In embodiments such as that illustrated in FIGS. 1A-E, the present invention may be considered an improved garment 5 intended for wear about a person's lower trunk. The garment 5 preferably includes "garment material" (typically relatively non-elastic, as discussed herein) forming a back portion 20, a front portion 25, a first leg covering 30, and a second leg covering 35. The garment 5 preferably also includes a relatively stretchable material 10 forming part of the garment so that stresses on the garment can be at least partially absorbed by elastic deformation of the stretchable material 10.

Similarly, in embodiments such as illustrated in FIGS. 2A-B, the present invention may be considered an improved shirt 65 for wear by a person. The shirt 65 preferably has garment material forming a front section, a back portion 90, a first arm covering 70, and a second arm covering 75, with stretchable material 10 located between garment material.

Thus, in the illustrated embodiments of FIGS. 1A-E and 2A-B, the elongated strips of relatively stretchable material extend continuously from an edge of the first limb section remote from said torso section, across said first limb section and said torso section and said second limb section, to an edge of the second limb section remote from said torso section. Among other things, this edge-to-edge reach of the stretchable material allows not only for the stretching discussed herein, but also can reduce "twisting" type distortion of the garment (that would otherwise occur during extreme motions of the wearer's body). In that regard, the edge-to-edge arrangement effectively bisects the less-stretchable portion of the garment, and permits some degree of "longitudinal shifting" of the garment's relatively less-stretchable portion. In other words, for embodiments having the aforementioned edge-to-edge configuration of stretchable material 10, the stretch of the material is not limited to expansion that is transverse to the lengthwise "axis" of the elongated strip. In addition to that expansion (which can be thought of as expansion generally perpendicular to the lengthwise axis of the strip), the strip permits the garment to "slip" or "shift" along a plane somewhat parallel to the strip's lengthwise axis. Such "parallel slip" or shifting can reduce or eliminate wrinkling or binding that might otherwise occur in that region of the garment.

The invention further includes a wide variety of methods associated with the garment described herein. Among others, such methods include those of constructing a garment, including the steps of (1) providing a main garment portion fabricated from relatively less-stretchable or non-stretchable material, with the main garment portion sized and configured to fit loosely on the wearer; (2) providing a second garment portion, the second portion fabricated from relatively stretchable material, the second portion sized and configured to fit loosely on the wearer and be stretched only when the wearer flexes his or her body from its normal relaxed position; (3) assembling the second garment portion between sections of the main garment portion, the assembled main and second garment portion each covering separate areas of the wearer's body and collectively covering a desired area of the wearer's body.

Further method steps include, by way of example and not by way of limitation, providing the second garment portion in the form of an elongated strip having first and second longitudinal edges generally parallel to a longitudinal axis of the strip, the strip also having first and second ends at the extremities of the longitudinal axis of the strip, positioning the first end to form a portion of an edge of the garment, attaching the first and second longitudinal edges to corresponding edges of the main garment portion, and positioning the second end of the strip to form another portion of an edge of the garment.

While certain embodiments are illustrated in the drawings and are described herein, including preferred embodiments, it will be apparent to those skilled in the art that the specific embodiments described herein may be modified without departing from the inventive concepts described. For example, while certain features of the present invention are illustrated as physically being in a particular location, having a specified dimensions, or applied to a definite garment, persons of ordinary skill in the art will understand that other location, dimensions, and garments can be used without departing from the inventive concept.

What is claimed is:

1. Board shorts for use during surfing or similar activities, including:

a first portion fabricated from a less stretchable material, said first portion comprising the majority of said shorts, and a second portion fabricated from a more stretchable material, said second portion configured and positioned in said shorts to provide elastic stretching of said second portion during movement of the wearer's body;

said second portion extending in an arcuate path from the front of one thigh of a first leg of said shorts, upward along the first leg, around the side of the shorts to the back of the shorts, across the back of the shorts, around the other side of the shorts, downward along the second leg to the front of the second thigh of said shorts;

said first portion comprising un upper ring configured to encircle the wearer's torso, said first portion extending continuously from a front section of said upper ring downwardly through a crotch portion and then upwardly to operatively join a lower edge of said second portion, said second portion comprising an elongated strip that is operatively abutted along both a first edge and a second edge by first portion.

2. The shorts of claim 1, in which said second portion extends from a lower edge of a first leg of said shorts across the buttocks area of the shorts, and down to a lower edge of a second leg of shorts.

3. The shorts of claim 2, in which said second portion extends across the buttocks along a generally upper area of the shorts and is sized and positioned to return to a relatively unstretched condition after said movement of the wearer's body.

4. The short of claim 1, in which said second portion is positioned as an elongated strip of material connected at most of its edges to said first portion of material.

5. The short of claim 1, in which said second portion is fabricated from elastomeric foam.

6. The short of claim 1, in which said second portion is fabricated from 4-way stretch neoprene.

7. The shorts of claim 1, in which second portion is a solid piece of material without any internal seams.

8. Board shorts for water related activities, the shorts, comprising:

a first limb section configured to receive within and permit to pass therethrough one limb of the person;

a second limb section configured to receive within and permit to pass therethrough second limb of the person;

a torso section joining the first limb section and the second limb section, the torso section having a back portion and a front portion, said back portion and said front portion configured to receive a corresponding portion of a person's torso; and an elongated strip of material more stretchable than adjacent materials in said first and second limb sections and said torso section, said elongated strip extending in an arched manner across all of the back portion of the torso section said strip having opposite ends extending respectively diagonally down around opposite sides of the torso section and extending further downwardly and around to a front inside portion of said first limb section and said second limb section, said strip positioned and configured so that rotations of said limbs with respect to the wearer's torso cause the elongated strip to stretch;

said torso portion extending around the wearer's waist and downwardly from an uppermost front edge of the shorts continuing downwardly through a crotch portion, and up into the area of the buttocks and adjacent a lower edge of said elongated strip, said elongated strip thereby defining a continuous stretch plane within the shorts, said plane running across the wearer's buttocks and around the wearer's hips and downwardly across the front of the wearer's thighs, wherein said elongated strip of material extends along an entire length of each said first limb and said second limb sections and said torso section and attaches to an inside front edge of said first limb section and said second limb section.

9. The shorts of claim 8, wherein the said stretchable material is elastomeric foam.

10. The shorts of claim 8, in which said garment is sized and configured to fit loosely rather than snugly against the wearer's body when the wearer is in a normal standing position.

* * * * *